US006530581B2

(12) United States Patent
Lai

(10) Patent No.: US 6,530,581 B2
(45) Date of Patent: Mar. 11, 2003

(54) ILLUMINATING ROLLER

(76) Inventor: Fang-Cheng Lai, PO Box 82-144, Taipei (TW)

( * ) Notice: Subject to any disclaimer, the term of this patent is extended or adjusted under 35 U.S.C. 154(b) by 0 days.

(21) Appl. No.: 09/732,761

(22) Filed: Dec. 11, 2000

(65) Prior Publication Data

US 2002/0125657 A1 Sep. 12, 2002

(51) Int. Cl.[7] ..... A63C 17/22

(52) U.S. Cl. ..... 280/11.203; 280/816; 301/5.3; 301/64.7; 362/78

(58) Field of Search ..... 280/11.203, 11.19, 280/11.23, 11.27, 87.042, 807, 809, 811, 816; 301/5.3, 5.7, 64.7; 310/67; 152/323; 362/78; 429/98, 97, 99

(56) References Cited

U.S. PATENT DOCUMENTS 4,342,913 A * 8/1982 Shepherd ..... 250/364
5,308,152 A * 5/1994 Ho ..... 152/323
5,536,074 A * 7/1996 Hsu et al. ..... 301/5.301
5,552,972 A * 9/1996 Rezvani ..... 280/11.203
5,649,716 A * 7/1997 Zhang ..... 280/11.19
5,653,523 A * 8/1997 Roberts ..... 362/158
5,718,499 A * 2/1998 De Caro ..... 280/11.203
5,730,520 A * 3/1998 Hsu et al. ..... 362/103
5,779,344 A * 7/1998 Tseng ..... 362/103
5,810,450 A * 9/1998 Tsu et al. ..... 301/5.301
5,839,814 A * 11/1998 Roberts ..... 280/11.19
6,106,074 A * 8/2000 Chang ..... 280/816

* cited by examiner

*Primary Examiner*—Brian L. Johnson
*Assistant Examiner*—J. Allen Shriver
(74) *Attorney, Agent, or Firm*—Leong C. Lei

(57) ABSTRACT

A novel vibration resistant illuminating roller in which all the electronic parts are connected to the circuit board by dint of the soft lead. Each illuminating kit, battery compartment, circuit board are provided with the upper and lower cushion device. The illuminating kit has two illuminators, oppositely disposed in the transparent hub cover. Two illuminators are supported by the cushion and emit the light on both sides of the illuminating roller. The cushion device furnishes great vibration and impact resistance.

2 Claims, 11 Drawing Sheets

(4~4)

(5~5)

(6~6)

ILLUMINATING ROLLER

BACKGROUND OF THE INVENTION

A common illuminating roller mounted on the skate board cart, in-line roller skate, ice skate in most cases employs a controlled flasher or an illuminating electronic parts fixed on a piece of ring type circuit board, such as shown in the FIGS. 13 and 14, the ring circuit board (40, 50) occupies a huge space of the hub cover of the roller. The circuit board is outfitted with an IC (41, 51), an illuminator (42, 52), a vibration switch (43, 53), and a battery, (44, 54). Since the circuit board is a thin structure, fragile, less resistant to strong vibration. Even the circuit is mounted in the plastic roller with external jacket as its protection, However, when under tough and violent vibration, the circuit board (40, 50) is easily susceptible to crack and damage. Per the USA safety test, the illuminating roller to be tested is dropped from a height equaling to a seven-story building without creating a crack or losing the illuminating performance on it.

From this safety requirement, a vibration resistant illuminating roller was designed, such as U.S. Pat. No. 6,106,074, "The Illuminating roller for In-line Skate." The vibration resistant illuminating roller skates, as shown in the FIGS. 15A and 15B, comprise a battery (28), an upper and a lower conductors (24, 27), a vibration switch (25), an illuminator (26) being mounted in the troughs (212, 213, 214) of a hub cover (21). The circuit board (23) is reduced to the size to contain an IC (231). Since the size of the circuit board (23) is largely reduced, it is subjected to lesser vibration and crack, the vibration resistance is hereby much improved. However, the metal leads (251, 261) of the vibration switch (25) are connected to the circuit board (23). This kind of a rigid connection is vulnerable to disengagement in the vibrating condition. In addition, there provides no cushion between the circuit board (23), the illuminator (26) and the vibration switch (25), while the illuminating roller encounters harsh leaping, the electronic is unable to absorb the impact, the metal wire is therefore displaced, after a long time, the metal pins (251, 261) of the vibration switch (25) and the circuit board begin loose, break, and disengagement and the illuminator is no longer to function.

In general practice, the illuminator is usually installed on same side of the rollers, while the illuminating roller is rolling, only one side light is visible, not on the both side, this is a stain on a perfect piece of the white paper.

In addition, the upper and the lower hub covers (21, 22) are linked together by the post (223) and the socket (215). The exterior of the hub cover is covered with a jacket, but not pierced into the hub covers (21, 22). The attachment and stability are very weak, once under continuously drastic impact, it is easy for the jacket to lose the attachment and separate from the hub covers.

SUMMARY OF THE INVENTION

The invention relates to a novel vibration-resistant illuminating roller constituting a pair of hub covers, a jacket wrapped on the exterior of the hub covers, a small sized circuit board, a plurality of illuminators, a battery compartment, and a vibration switch. In which the circuit board has two layers, the battery compartment, and two layers too. The lower portion of the illuminator is provided with a cushion protection to absorb the vibration encountered in rolling and protect the electronic parts from excessive up-down movement and displacement. Each electronic parts is connected with the circuit board by dint of soft lead wires, sealed with the silicone rubber to strengthen connection, insulation, moist proof and fracture. These two illuminators are symmetrically installed in hub cover with cushion protection surrounded, so the light is visible on both sides. This composition of illuminating roller is capable of bearing dramatic impact under high-speed rotation without creating damage, crack and short circuit.

DETAILED DESCRIPTION OF THE INVENTION

Figure 1:
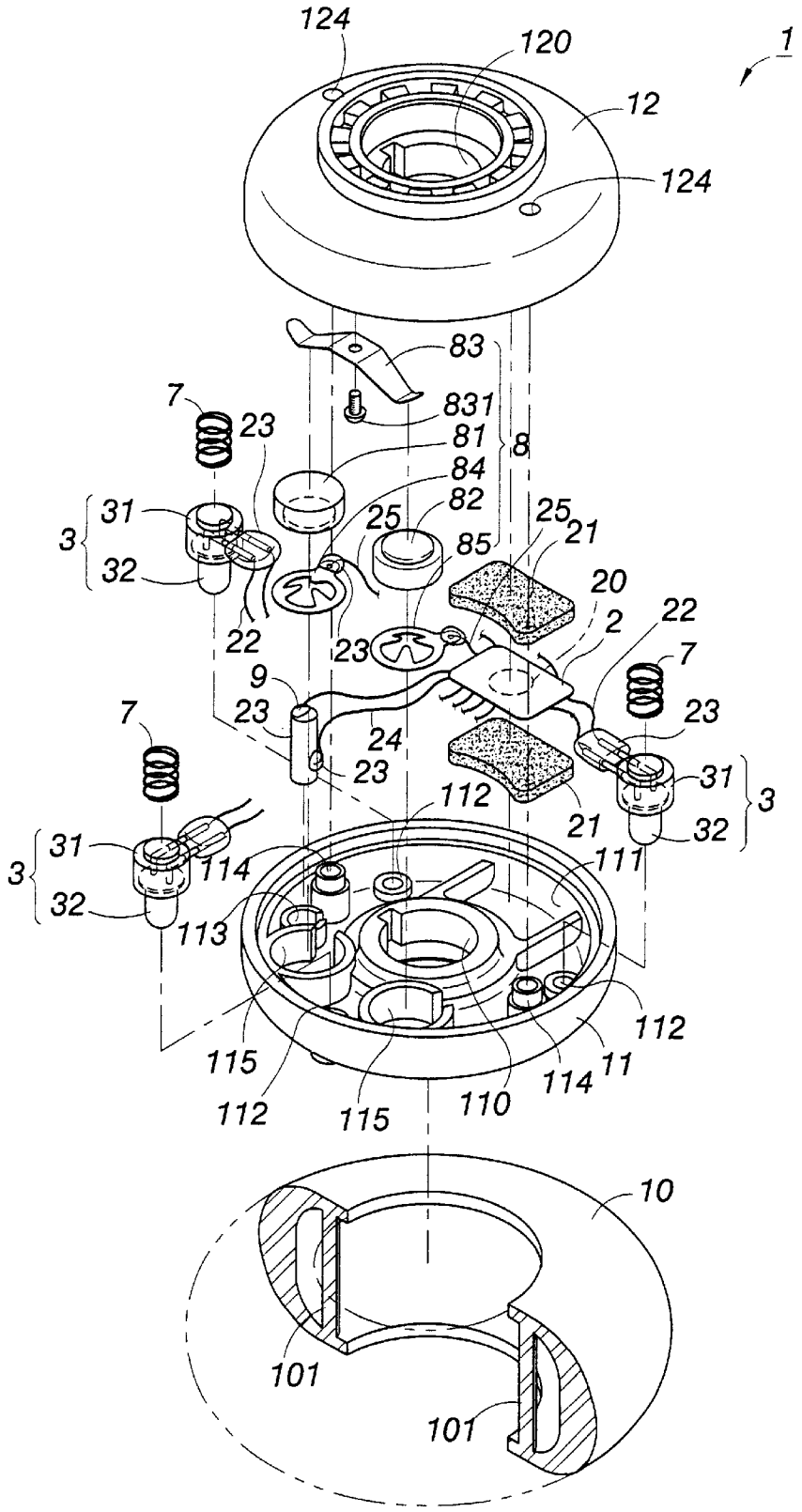
FIG. 1 shows the stereo disassembly of illuminating roller of the invention.

The stereo disassembly of the illuminating roller of the invention is shown in the FIG. 1, where the illuminating roller 1 constitutes two plastic hub covers 11 and 12. As displayed in the hub cover 11, there is a central axle opening 10, a circuit board trough 111 surrounding the opening periphery, three slots 112 situated at a triangular position, a C shape guide trench 113, two retaining sockets 114, and two C shape battery compartment 115. The hub cover 12 has the similar symmetrical structure. Two hub covers 11 and 12 are joined together by means of ultrasonic technique or gluing. After two hub covers 11 and 12 join together, the retaining sockets 114 and 124 form a go-through hole as shown in the FIG. 4. The assembled hub cover is placed in a mold to be injected with a jacket 10 over the outside of the hub cover, and a retaining post 101 is therefore formed in the retaining sockets 114 and 124. After the jacket 10 cools down, it holds the hub covers 11 and 12 steadfastly to provide an outstanding impact resistance, and will never shed off even under the dramatic vibration and collision. It take the place of the prior art of illuminating roller which use bolt or glue to hold the jacket onto the hub cover.

Figure 2:
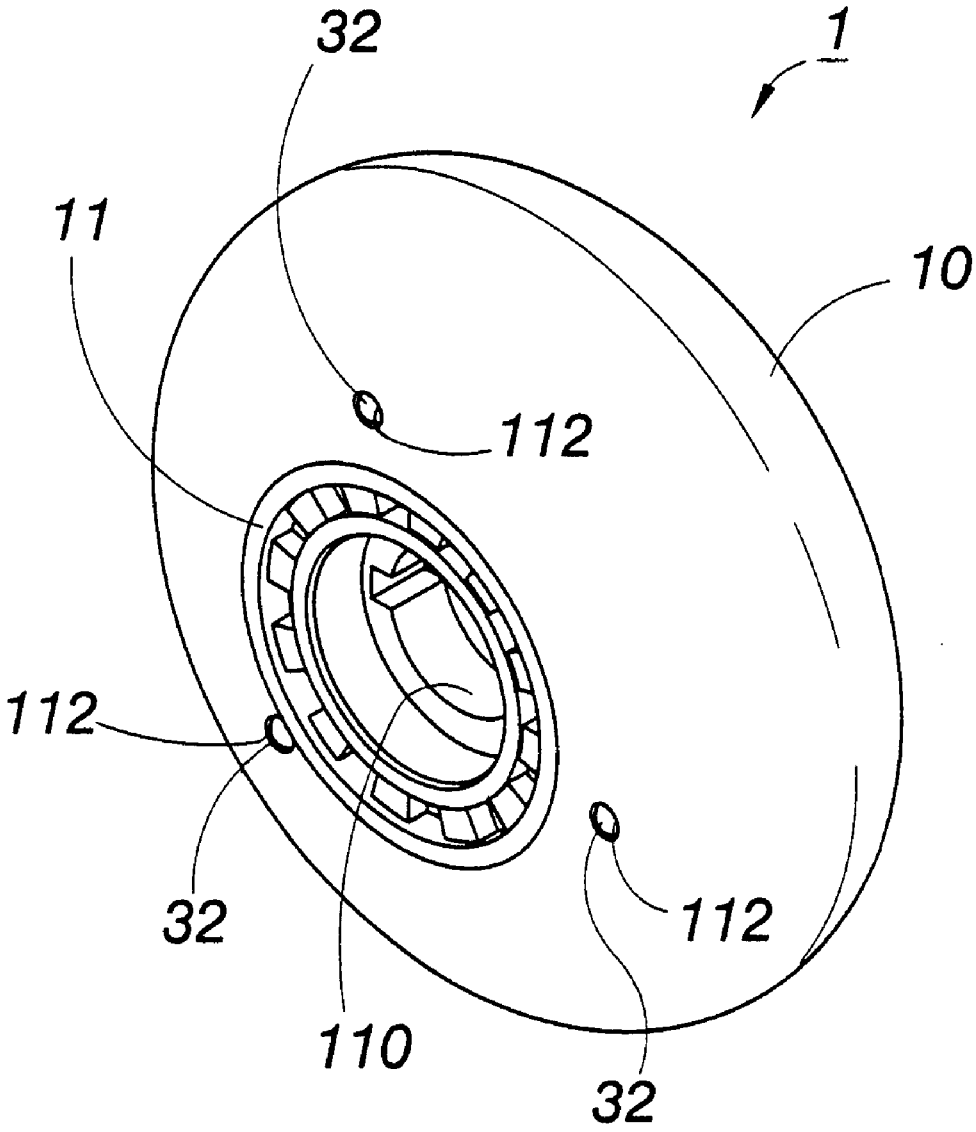
FIG. 2 illustrates the stereo assembly of illuminating roller of the invention.
Figure 3:
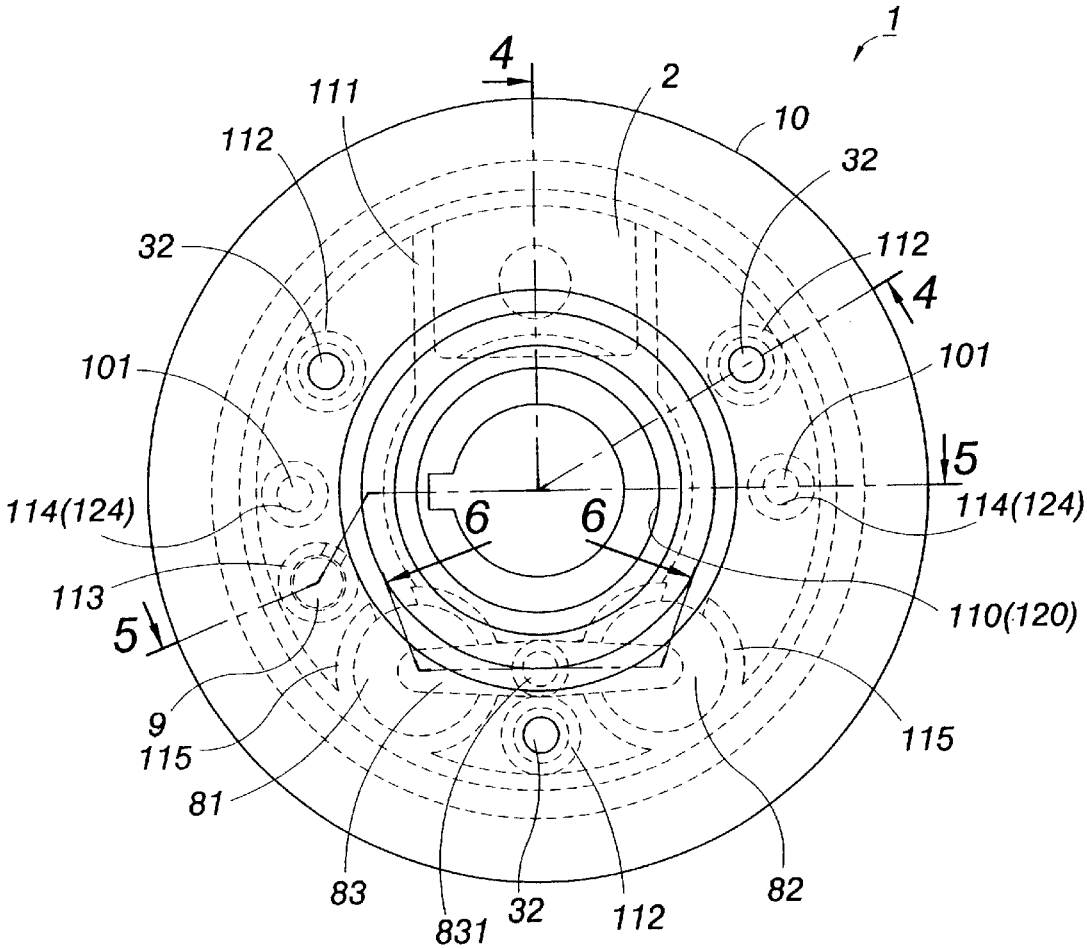
FIG. 3 displays an overall view of illuminating roller of the invention.

Prior to joining hub covers 11, 12 together, many electronic parts and components will be installed in the hub cover, such as a circuit board 2, three illuminators 3, two battery kits 8, and a vibration switch 9. The layout of the electronic parts or components is shown in the FIG. 3, where, the circuit board is laid in the circuit board trough 111, the illuminator 3 is composed of a seat 31 and common illuminator 32 (LED) and the illuminator 32 is inserted in the slot 112. The battery kid constitutes two batteries 81, 82, a V-form metal spring strip 83, and two spring strips 84, 85, in which the batteries 81, 82, and spring strips 84 85 are erected in the battery compartment 115. The vibration switch 9 is inserted in the guide trench 113. After completing the assembly of illuminating roller 1, the appearance is demonstrated in the FIG. 2, the central axle opening 112 and the illuminator 32 in differed diameter emerge on one side of the illuminating roller 1.

Figure 4:
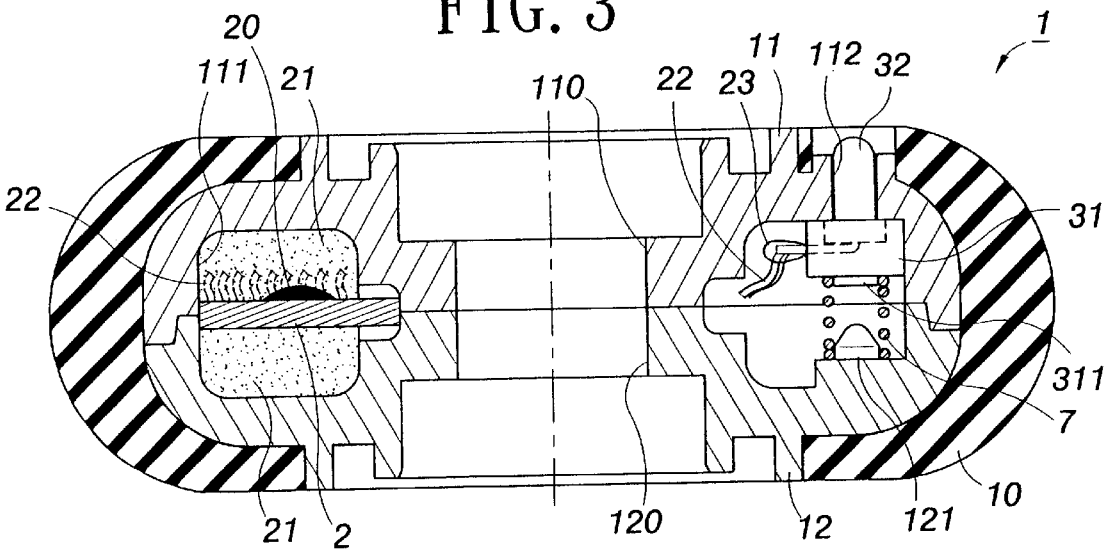
FIG. 4 is the section from 4—4 of FIG. 3, indicating the assembly of the illuminator mounted on the circuit board.

The FIGS. 1 and 4 presents the special characteristics of this invention. To reduce the impact effect to the minimum extent on the illuminating roller, each electronic parts and component are protected with cushion material. Whereas the circuit board 2 containing an IC chip 20 is sandwiched with two layers of foam rubbers 21 on the upper and lower sides and inserted in the circuit board trough 111. The bottom of each electronic parts is furnished with cushion, taking the illuminator 32 as an example, there installs a spring 7 at the bottom of seat 31, the said spring sits on projected cone 121 in the hub cover 12. The illuminator 32 is always confined in the slot 112 by the force of the spring 7, When the roller is jumping up, the seat 31 will never bounce out of the slot 112 and the spring 7 will absorb the vibration and automatically retain the seat 112 in position. The two lead wires of the illuminator are bent and soldered to the soft lead 22 and sealed with silicone resin to reinforce effect of connection, insulation, moisture-proof and fracture prevention.

Figure 5:
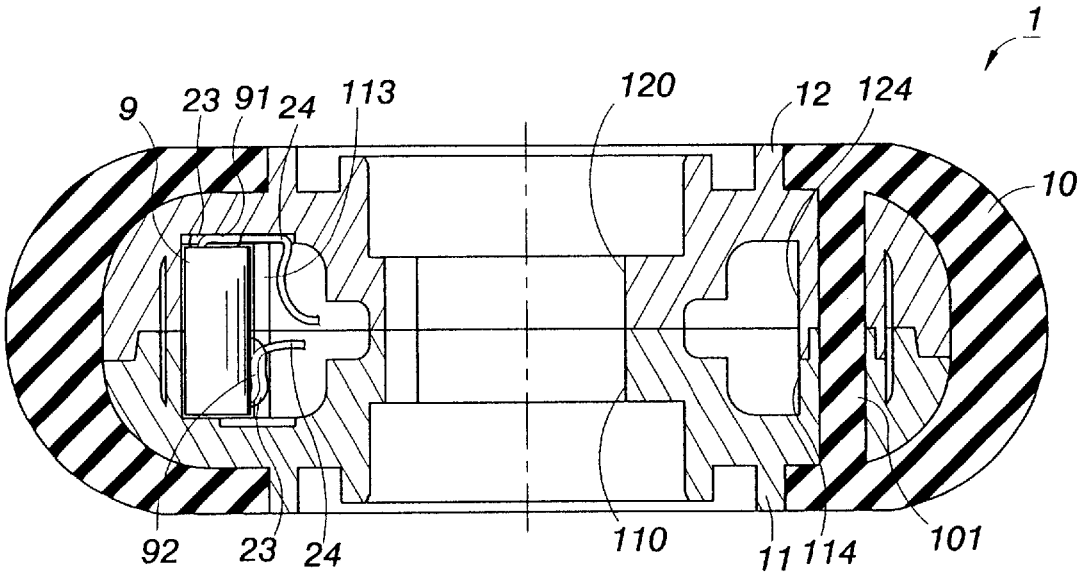
FIG. 5 is the section from 5—5 of FIG. 3, indicating the assembly of the vibration switch.

The FIG. 5 displays the structure of the vibration switch 9. In the static condition, the vibration switch 9 is non-conductive; the whole illuminating circuit is shorted. While in the vibration environment, the circuit becomes conductive. The vibration switch, even requiring too excessive protection, is still in need of a special attention in designing the power supply cable. The prior art of the vibration switch applies rigid power cable, which is easily vulnerable to break during the violent movement. This invention adopts a soft connection, where the vibration switch 9 has two power supply leads 91, 92. The upper lead 91 extends outward from the top, and the lower lead 92 from the bottom. Two leads are connected to a soft lead 24 respectively, then sealed with silicone resin 23 to ensure good connection, insulation, moisture-proof and fracture prevention.

Figure 6:
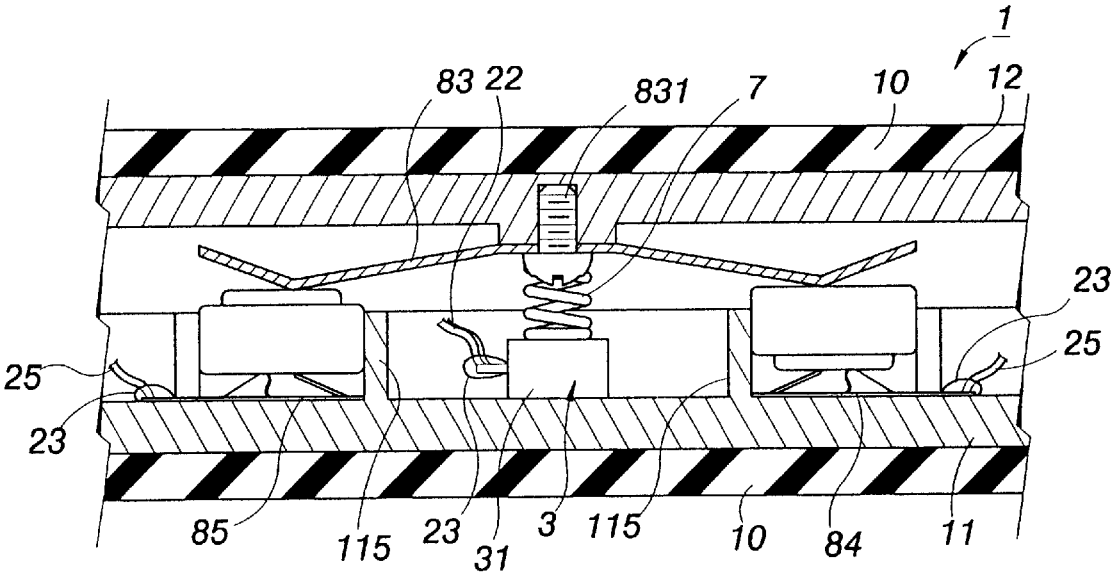
FIG. 6 is the section from 6—6 of FIG. 3, indicating the assembly of the battery compartment.

As shown in the FIG. 6, the batteries 81, 82 are provided with cushion too. In which the top end of the batteries is supported by the V shape spring strip 83, which further serves as the series connector between two batteries. The V shape spring strip is fastened by a bolt 831 to the inner wall of the hub cover 12. The bottom end of the batteries are supported by the metal spring strips 84, 85 which are in the claw form obliquely extending upward to hold the batteries. While the batteries are subjected to dramatic movement, the metal spring strip will take in the up down leaping to prevent the batteries from disengaging. The metal spring strips 84, 85 is connected to the soft lead 25 respectively and sealed with silicone resin 23 to enhance the insulation, moisture-proof and fracture prevention. Relatively, the circuit board 2 is also linked to the soft leads 22, 24, and 25 and sealed with the silicone resin 23 to ensure good connection, insulation, moisture-proof and fracture prevention.

Figure 7:
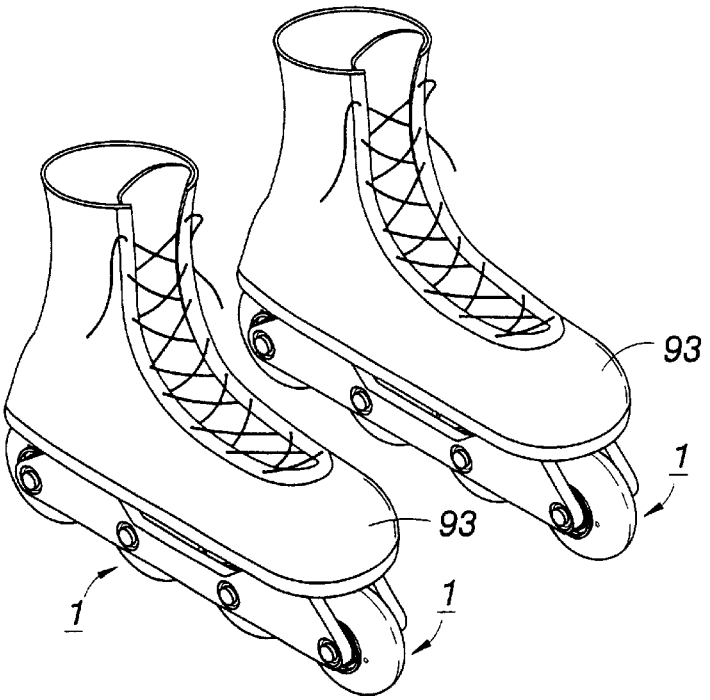
FIGS. 7 and 8 shows the practical application of the illuminating roller of the invention.
Figure 8:
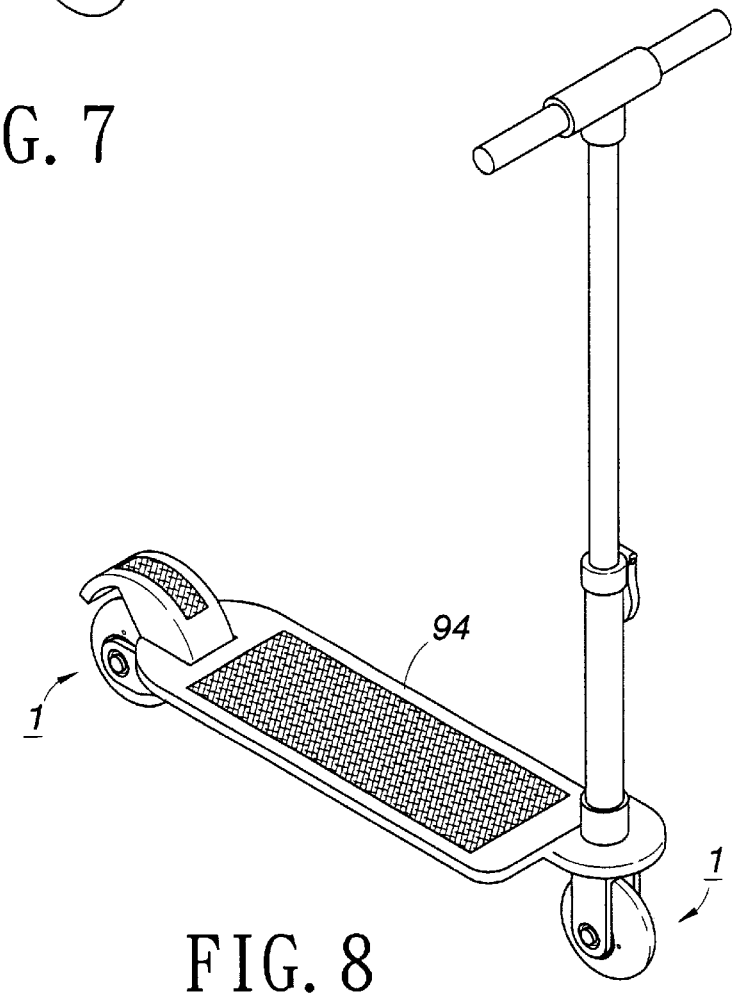

The FIGS. 7 and 8 show the practical application of the illuminating roller of the invention. The FIG. 7 shows that the illuminating roller 1 is installed on the in-line roller skates 93 and the FIG. 9 demonstrates the application of the illuminating roller 1 on the skate cart 94. The illuminating roller 1 of the invention has a wide application to the skateboard or toy cart with differed width and diameter of the rollers. In the violent movement, the electronic parts and batteries are held in place by the design cushion material and displacement is avoided. Furthermore, the electronic parts, battery spring strips and the circuit board are connected to the soft leads 22, 24, and 25, offering superb flexibility and extendibility; the disengagement is forever prevented. The performance of the illuminating roller provided in the invention is much better than prior art.

Figure 9:
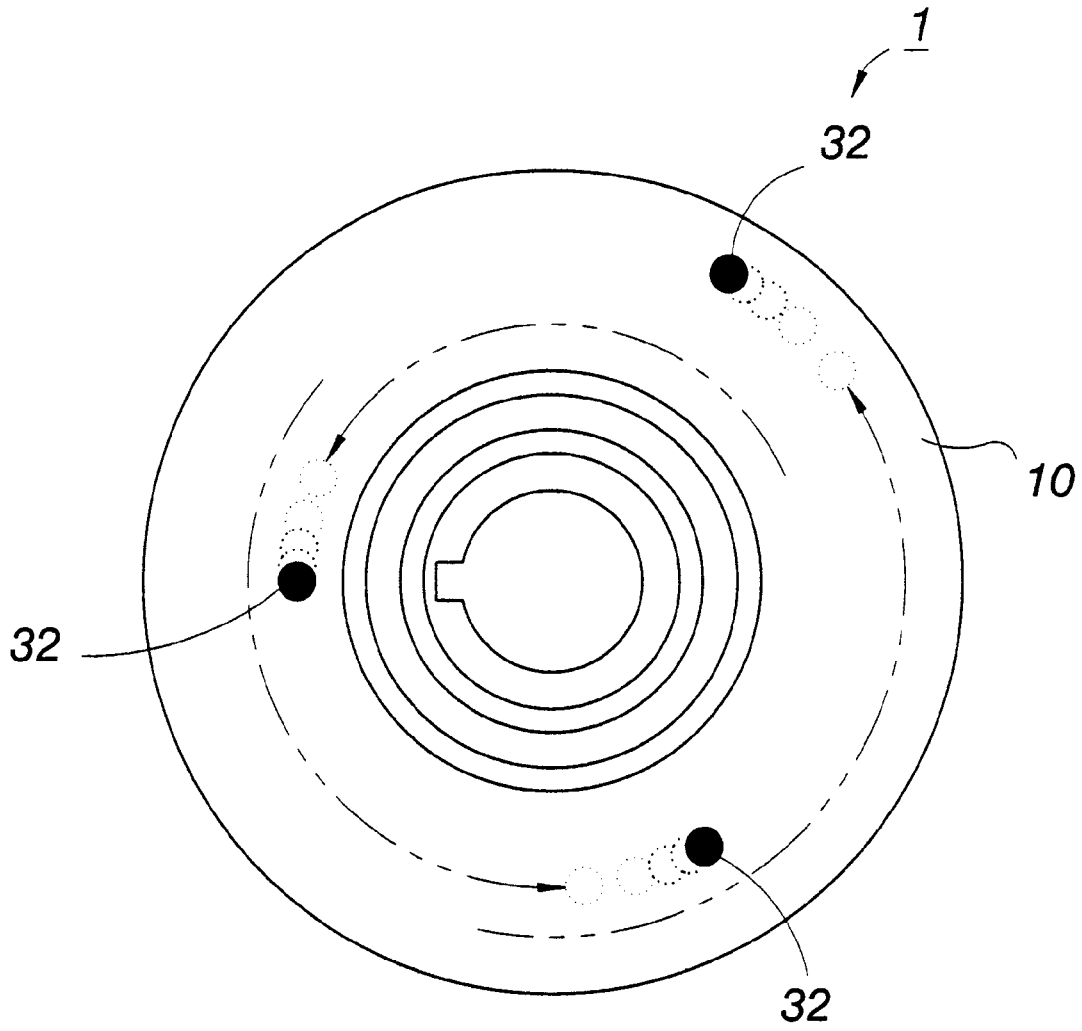
FIG. 9 displays a side view of illuminating roller of the invention.

The FIG. 9 displays the physical rolling action of the illuminating roller of the invention. There are three illuminators 32 with differed distance from the roller center. When illuminating roller 1 is rolling along, three illuminators 32 will produce three colored lighting rings.

Figure 10A:
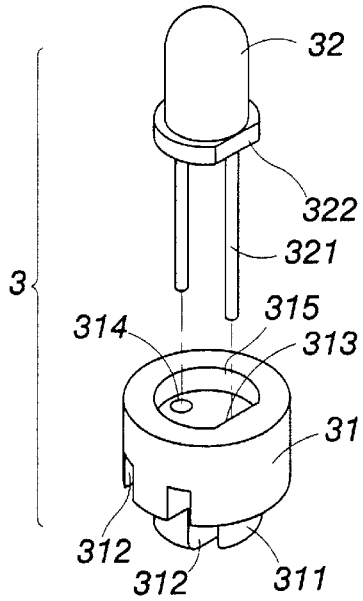
FIG. 10A shows the stereo disassembly of common illuminator used on the illuminating roller of the invention.
Figure 10B:
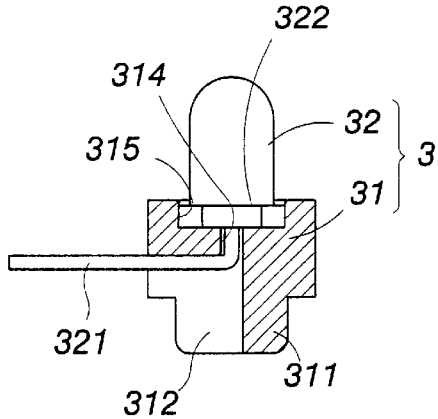
FIG. 10B illustrates the cross section of common illuminator shown on FIG. 10A.

The FIG. 10A shows the disassembled illuminator kit in which the illuminator kid 3 constitutes an illuminator seat 31 and an illuminator 32. The bottom of the seat 31 has a projection 311 with two longitudinal grooves 312. The illuminator 32 has two metal leads 321 which pass through the center opening 314 of the seat 31, then bend at right degree into the longitudinal groove 312 as shown in the FIG. 10B. The seat 31 has a recess 315 with a flat face 313. When the illuminator 32 is plugged into recess 315 of the seat 31, the flat face 322 of the illuminator 32 is flush with the flat face 313 of the seat 31 to restrain the illuminator 32 motionless within the seat 31.

Figure 10C:
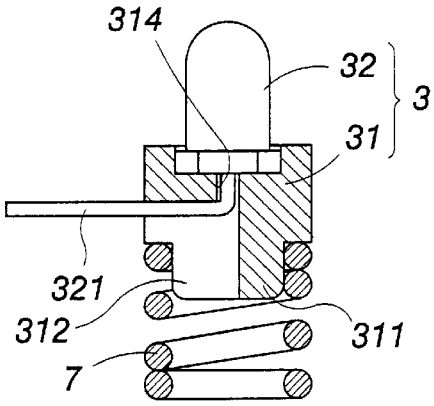
FIG. 10C demonstrates the assembly of illuminator and spring.

The FIG. 10C demonstrates the another embodiment of the illuminator seat and spring where the seat 31 has a projected bottom 311 permitting insertion of a spring 7 which serves as a cushion for the illuminator kit 3.

Figure 10D:
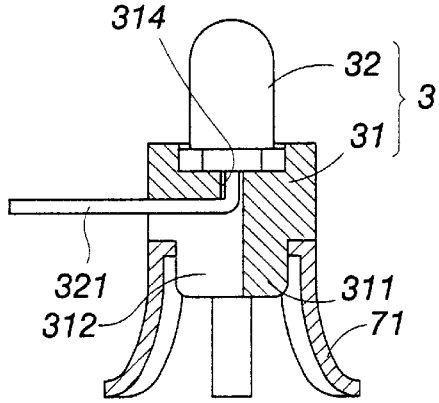
FIG. 10D shows the assembly of illuminator and metal ferrule.

The FIG. 10D shows another embodiment of the illuminator seat and the elastic ferrule. Where the projected bottom 311 of the seat 31 allows to envelop a metal ferrule 71 which has top open and a plurality of elastic brackets extending downward and working as cushion for the illuminator kit 3.

Figure 10E:
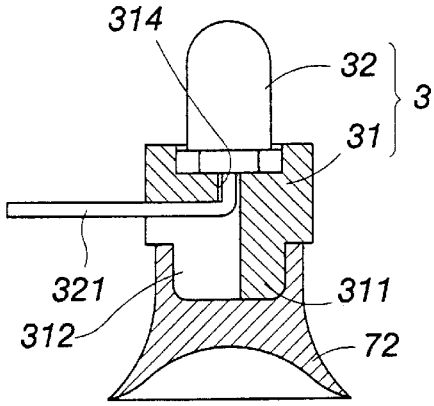
FIG. 10E demonstrates the assembly of illuminator and elastic plastic sleeve FIG. 10F demonstrates the assembly of illuminator and elastic foam cushion.

The FIG. 10E demonstrates another embodiment of the illuminator seat and the elastic plastic sleeve. Where the projected bottom 311 of the seat 31 permits the entrance of an elastic plastic sleeve 72. The elastic plastic sleeve 72 has a top groove and a hollow space on the bottom to act as a cushion for the illuminator kit 3.

Figure 10F:
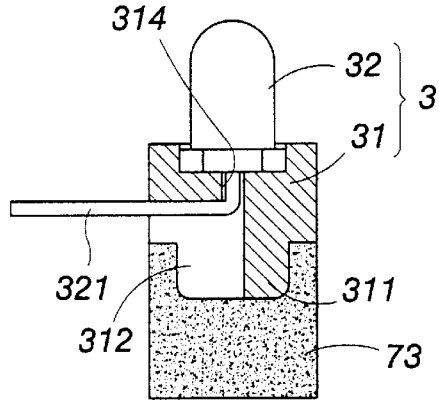

The FIG. 10F demonstrates another embodiment of the illuminator seat and the elastic foam cushion. Where the projected bottom 311 of the seat 31 is attached with a film of elastic foam rubber 73, or polylon, sponge or rubber block acting as the cushion for the illuminator kit 3.

Figure 11A:
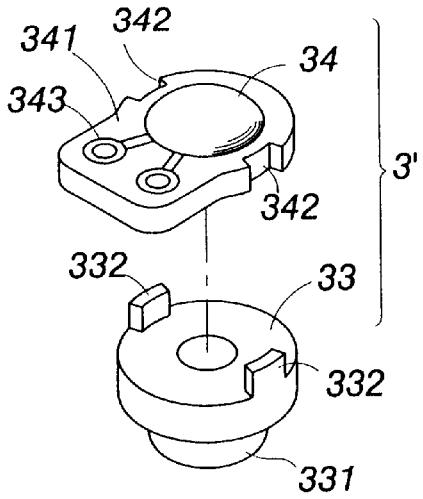
FIG. 11A shows the stereo disassembly of small illuminating kit of the invention.
Figure 11B:
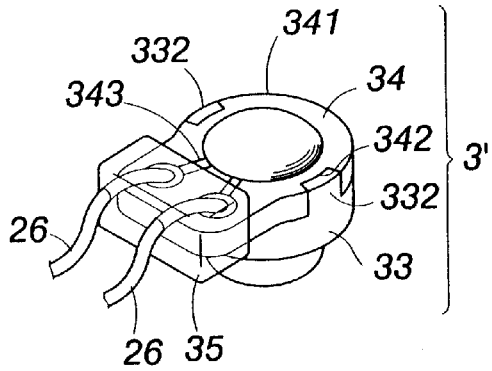
FIG. 11B shows the stereo assembly of small illuminating kit of the invention as shown in FIG. 11A.

The FIG. 11A shows the stereo disassembly of the small illuminating kit of the invention. The said illuminating kit 3' consists of a seat 33 and a small illuminator 34. The seat 33 has a projected bottom 331 with a pair of tenon joint 332 extending upward; the small illuminator 34 (flat LED) is fixed on a flat circuit board 341. The flat circuit board has a pair of notch, intimately fitting with the tenon joints 332 of the projected bottom 331 as shown in the FIG. 11B. The two metal leads 343 of the small illuminator 34 will go through two holes 344 of the circuit board 341 and connect to the soft leads 26. Both are sealed with silicone resin 23 to ensure high quality of joint, insulation, moisture-proof and fracture prevention. In addition, the small illuminating kit 3' can be simplified to comprise the small illuminator 34 and flat circuit board 341 without the seat 33.

Figure 12:
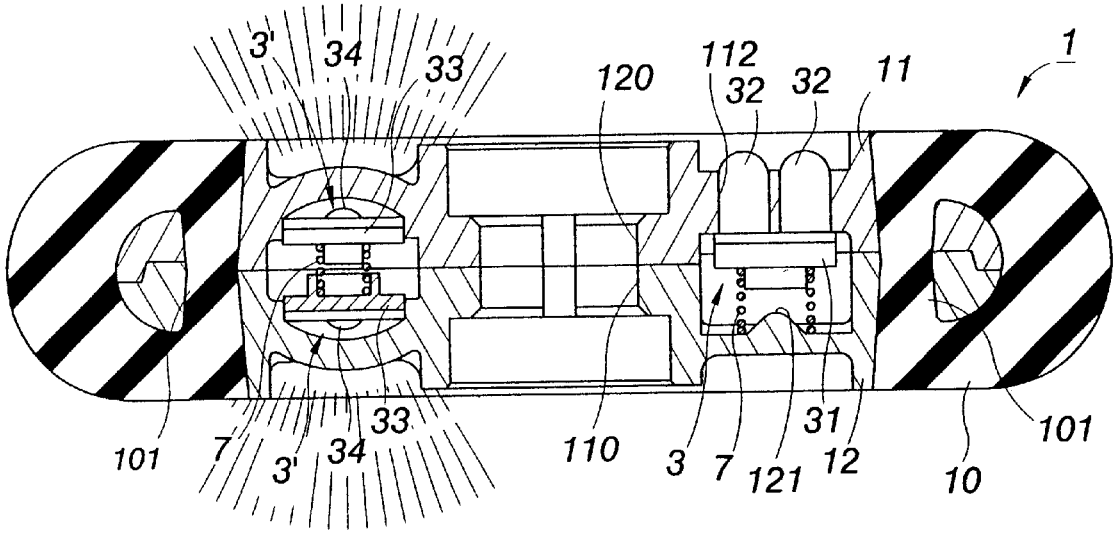
FIG. 12 is a schematic diagram of another embodiment of illuminating roller of the invention.
Figure 13:
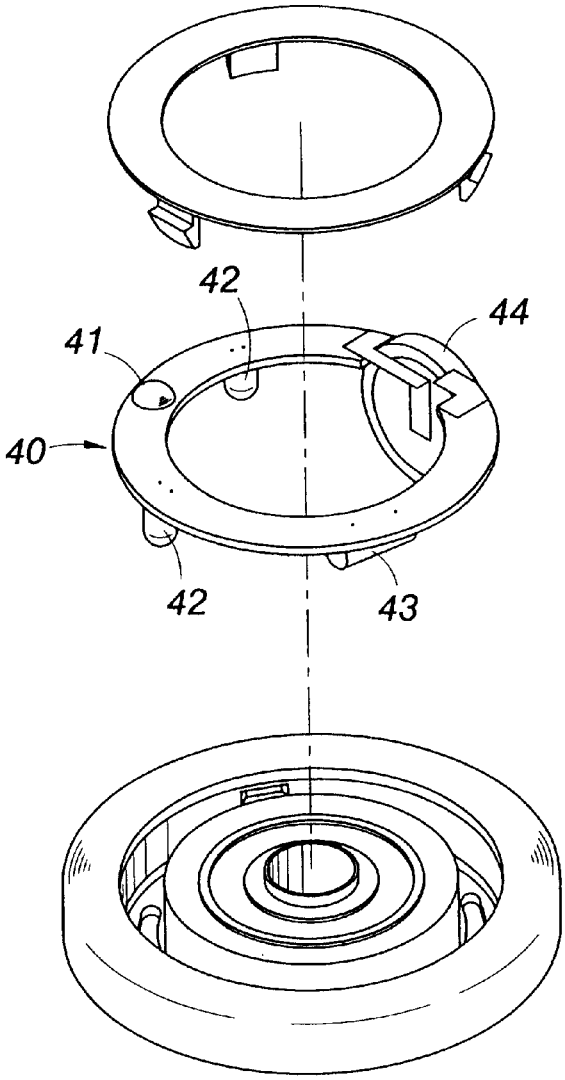
FIG. 13 (PRIOR ART)
FIG. 13 shows the stereo disassembly of prior art of illuminating roller.
Figure 14:
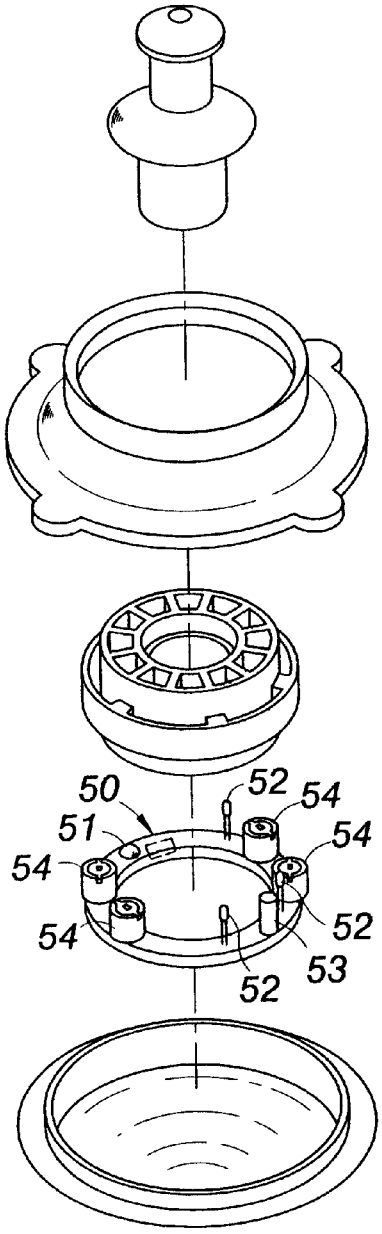
FIG. 14 (PRIOR ART)
FIG. 14 shows the stereo assembly of prior art of illuminating roller.
Figure 15A:
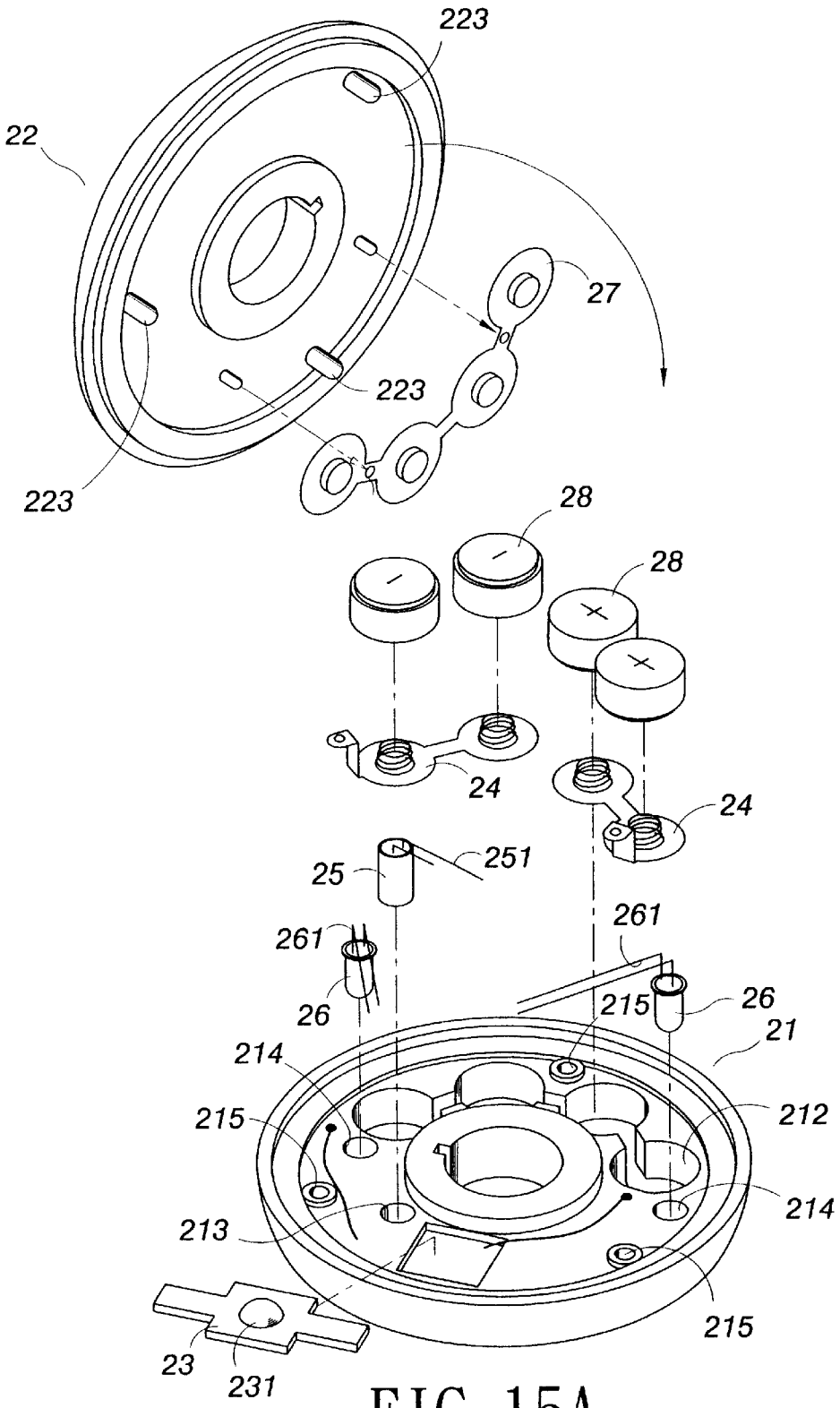
FIG. 15A (PRIOR ART)
FIG. 15A shows the stereo disassembly of U.S. Pat. No. 6,106,074 illuminating in-line skate.
Figure 15B:
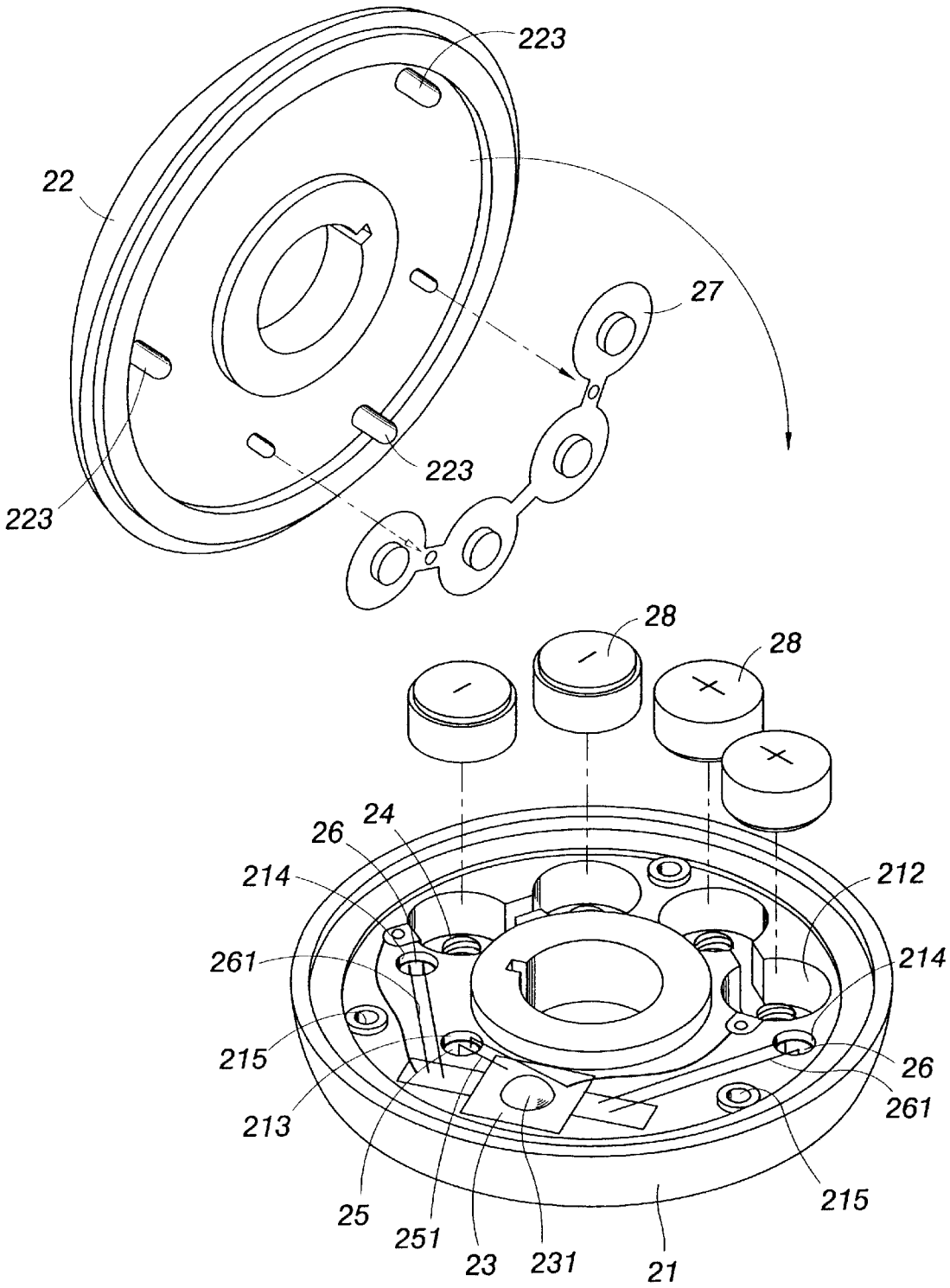
FIG. 15B (PRIOR ART)
FIG. 15B shows the stereo assembly of U.S. Pat. No. 6,106,074 illuminating in-line skate.

The FIG. 12 is the cross section of another embodiment of the illuminating roller of the invention. Where it exposes the common illuminating kit 3 on the right side, and the small illuminating kit 3' on the left side. In which the illuminating kit 3 comprises one seat 31 and two illuminators 32, the hub cover has therefore two slots 112 to accommodate two illuminators to attain better illuminance for the illuminating roller 1. The small illuminating kit 3' (with or without the seat 33) has two illuminator 32 oppositely situated with a spring for mutually supporting two illuminators 32. The light generated from the illuminators will radiate outward out of the hub cover. Because the illuminator small in size can be hidden in the hub cover, so it is preferably that the hub covers material be transparent or translucent allowing the light passing through both side of the hub cover. This design is much better than the prior art of the illuminating roller.

The invention has attained the following remarkable effects.

(1) The illuminator, circuit board and battery are well protected with elastic cushion to reduce the damage and displacement to the minimum extent while the illuminating roller is under violent vibration.

(2) The illuminator, vibration switch, battery compartment and circuit board are connected with the soft lead wire which provides great flexibility to prevent the lead from breaking and disengaging. The soft lead terminals are sealed by dint of silicone resin to ensure better moisture resistance.

(3) The illuminating kit is permissible to install two illuminators arranged in the opposite direction, so the light can be visible on both sides of the illuminating roller. The illuminating kit with two illuminators can be hidden in the hub cover to achieve moisture proofing.

What is claimed is:

1. A novel vibration resistant illuminating roller comprising a pair of symmetrically matched hub covers, a jacket wrapped over the hub covers and electronic parts installed internally in the hub covers, the electronic parts including:

a plurality of illuminating kits each consisting of an illuminator and a seat to hold the illuminator, two longitudinal grooves being cut beneath the seat, two leads of the illuminator passing a center hole of the seat, bending at a right angle, lying in the grooves and connecting to soft leads, a bottom of the seat being outfitted with a cushion device;

a circuit board containing an IC for controlling flash of the illuminating kits;

a battery compartment to supply power to the illuminating kits and IC; and a vibration switch to induce power supply to the electronic parts once activated by a vibration;

the electronic parts being provided with upper and lower cushions to absorb vibration except the vibration switch.

2. A novel vibration resistant illuminating roller comprising a pair of symmetrically matched hub covers, a jacket wrapped over the hub cover and electronic parts installed internally in the hub covers, the electronic parts including:

a plurality of illuminating kits consisting of a seat, two illuminators and a flat board, the seat having a plurality of projected tenon joints, the illuminators being mounted on the flat board and oppositely disposed in the hub covers, the illuminators facing outward and light produced by the illuminators being able to be seen through the hub covers, the flat board having a plurality of notches in same number of the projected tenon joints thereby forming an integral part;

a circuit board containing an IC for controlling flash of the illuminating kits;

a battery compartment to supply power to the illuminating kits and IC; and a vibration switch to induce power supply to the electronic parts once activated by a vibration.

* * * * *